US007789141B2

(12) United States Patent
Zhuravlev et al.

(10) Patent No.: US 7,789,141 B2
(45) Date of Patent: Sep. 7, 2010

(54) OIL RECOVERY ENHANCEMENT METHOD

(75) Inventors: Oleg Nikolaevich Zhuravlev, Reutov (RU); Dmitry Anatolevich Koroteev, Moscow (RU); Konstantin Igorevich Popov, Dubna (RU)

(73) Assignee: Schlumberger Technology Corporation, Cambridge, MA (US)

( * ) Notice: Subject to any disclaimer, the term of this patent is extended or adjusted under 35 U.S.C. 154(b) by 8 days.

(21) Appl. No.: 11/964,381

(22) Filed: Dec. 26, 2007

(65) Prior Publication Data

US 2008/0156483 A1 Jul. 3, 2008

(30) Foreign Application Priority Data

Dec. 28, 2006 (RU) ..... 2006146963

(51) Int. Cl.
*E21B 43/00* (2006.01)
*G01V 1/40* (2006.01)

(52) U.S. Cl. ..... 166/249; 166/177.1; 181/106; 181/113

(58) Field of Classification Search ..... 166/249, 166/177.1, 177.5–177.7; 181/106, 113
See application file for complete search history.

(56) References Cited

U.S. PATENT DOCUMENTS

| | | | | |
|---|---|---|---|---|
| 5,109,922 | A | 5/1992 | Joseph | |
| 5,460,223 | A * | 10/1995 | Economides | 166/249 |
| 6,899,175 | B2 | 5/2005 | Kostrov et al. | |
| 7,042,228 | B2 * | 5/2006 | Lally et al. | 324/527 |

FOREIGN PATENT DOCUMENTS

| | | | |
|---|---|---|---|
| RU | 2162519 | C2 | 1/2001 |
| RU | 2267601 | C2 | 10/2006 |

* cited by examiner

*Primary Examiner*—Kenneth Thompson
*Assistant Examiner*—Yong-Suk Ro
(74) *Attorney, Agent, or Firm*—Brigid Laffey; Vincent Loccisano; James McAleenan

(57) ABSTRACT

The current invention provides an improved method of increasing well yield and enhancing oil production. The method comprises the steps of lowering a vibroacoustic downhole emitter into a well down to a production layer depth and performing acoustic impact on the formation. The impact is implemented by a multiple frequency signal containing at least two simple harmonic components whose frequencies and amplitudes meet the resonance overlapping condition.

5 Claims, 1 Drawing Sheet

OIL RECOVERY ENHANCEMENT METHOD

CROSS-REFERENCE TO RELATED APPLICATIONS

The present application claims priority under 35 U.S.C. §119 of Russian Patent Application No. RU 2006146963, filed on Dec. 28, 2006, the disclosure of which is expressly incorporated by reference herein in its entirety.

FIELD OF THE INVENTION

This invention relates to the oil and gas industry and can be used to increase well yield and to enhance oil production.

BACKGROUND OF THE INVENTION

Among the methods for affecting formations and bottomhole zone of oil wells with the aim to increase their productivity, acoustical methods ensuring oil inflow from the production formation to the development area are widely spread.

Known methods are classified by an acoustical impact frequency band. Low-frequency methods applied for production formation impact increase the formation pressure and bring into development stagnant areas of the formation; however, the above-mentioned impact is only effective in case if impact frequencies are close to resonant frequencies defined by geophysical properties of the said formation (e.g., U.S. Pat. No. 6,899,175, 31 May 2005).

Ultrasonic methods applied for impacting a well production area at frequencies of 10-25 kHz change physicochemical properties of the impacted formation and lead to, e.g., a reduced oil viscosity (U.S. Pat. No. 5,109,922 of May 5, 1992), which, in its turn, facilitates the cleaning of pore space, however, the field of application of ultrasonic methods is limited to the well's nearest area.

Another known method of oil recovery enhancement is implemented through an acoustic impact on the formation in a broadened high-frequency span as well as in a low-frequency span; this ensures excitation of both adjacent production formations and those remote from the well (RF patent No. 2162519 of Jan. 27, 2001).

The method that calls for lowering a vibroacoustic downhole emitter in a well and performing a consecutive high-frequency and low-frequency impacts on the formation bottomhole area (RF patent No. 2267601) is the most similar to the claimed method. This method provides oil recovery increase due to an increased oil inflow.

However, the issue of a direct impact on a local fluid flow velocity in the oil formation's pore space remains unresolved.

SUMMARY OF THE INVENTION

The suggested method, besides the effects which were described above, also ensures an effective action directly on the parameters of a fluid flow in the formation pore space. A multi-frequency impact with a predefined set of frequencies or a simple noise impact, i.e. the impact with the application of a multi-frequency wide-band signal with a continuous spectrum of frequencies, results in a stochastization of the fluid flow field. The latter, in its turn, leads to substantial decrease of fluid's effective viscosity. A viscosity drop against the background of stationary depression results in a fluid flow velocity increase and, hence, in well production rate increase.

DETAILED DESCRIPTION OF THE INVENTION

Figure 1:
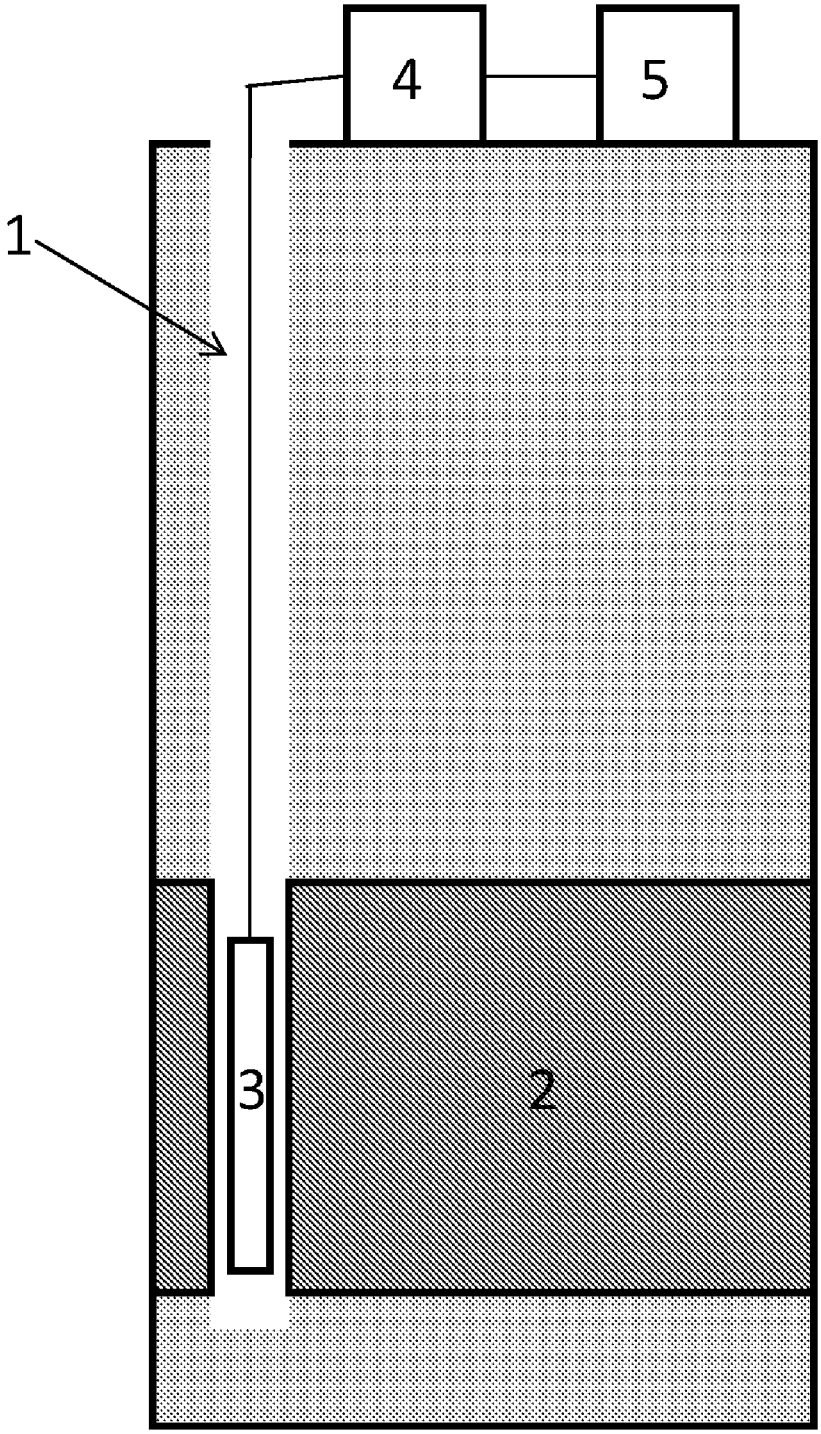
FIG. 1 is a side cross-sectional view of a well penetrating a formation.

In accordance with the suggested method for enhancing oil recovery in a well to be subjected to an acoustic treatment, a vibroacoustic downhole emitter is lowered into the well down to the production layer depth, and it impacts the formation by a multiple frequency signal that contains at least two simple harmonic components whose frequencies and amplitudes meet the resonance overlapping condition. It is also possible to implement the impact using a multiple frequency wide-band signal with a continuous frequency spectrum. The impact can be performed before starting oil production (to clean pore space in adjacent area), during oil production (to increase fluid yield) and while shutting a well (to keep permeability level).

A physical mechanism the suggested method is based on calls for the application of fluctuation-dissipation correlations for formation fluids. The acoustic impact by a multiple frequency signal which contains at least two simple harmonic components whose frequencies and amplitudes meet the resonance overlapping condition as well as impact by a multiple frequency wide-band signal with a continuous frequency spectrum reduces hydraulic resistance of the fluid flow in the formation's pore space and, therefore, increases the flow rate of formation fluids. The impact by using both the wide-band and multiple frequency signals with the parameters meeting the above condition result in a stochastization of the fluid flow velocity field. This provides the direct impact of the exciting signal on an average flow rate of the formation fluid in formation's pore space.

In case of impact by a multiple frequency signal which contains at least two simple harmonic components $P(t)=P_1 \sin(\omega_1 t)+P_2 \sin(\omega_2 t)$, the frequencies and amplitudes of these components must meet the resonance overlapping condition. This condition is fulfilled if $$\left|\frac{1}{2c\sqrt{\rho}}\frac{\omega_1\sqrt{P_1}+\omega_2\sqrt{P_2}}{\omega_1-\omega_2}\right|>1, \quad (1)$$

$$P_1 \approx P_2$$

where $P_1$ and $P_2$—signal amplitudes [Pa], $\omega_1$ and $\omega_2$—their frequencies [Hz], c—acoustic sound velocity in the formation fluid [m/s], ρ—formation fluid density.

The above relationship (1) is obtained by solving a problem of nonlinear oscillations resonance overlapping (see, for example, G. M. Zaslavskiy, R. Z. Sagdeev <<Introduction to nonlinear physics: from pendulum to turbulence and chaos>>, Moscow, Nauka, 1988). Multiple frequency impact on a mechanical system whose properties are nonlinear in relation to this kind of impact may lead to resonance overlapping effect appearance.

If the system response to the disturbing force is linear (for example, the deformation of an absolutely elastic rod is proportional to the force that compresses the rod), then in case of a multiple frequency impact the spectrum of oscillations excited in the system coincides with the spectrum of the exciting force. In other words, if a <<linear>> system is subjected to impact of a signal containing a set of sinusoidal oscillations with different frequencies $A_1 \sin(\omega_1 t)+A_2 \sin(\omega_2 t)+\ldots+A_n \sin(\omega_n t)$, then system oscillation spectrum will consist of a linear set of delta functions $B_1\delta(\omega-\omega_1)+B_2\delta(\omega-\omega_2)+\ldots+B_n\delta(\omega-\omega_n)$. The equation of natural oscillations for such a system can be presented as $x''+\omega^2 x=0$, where x characterizes the deviation from equilibrium, and x" is the second derivative with time.

But if the system reacts to deviations from equilibrium caused by the disturbing force in a nonlinear way (the equation of system's natural oscillations is nonlinear as to x, for example, $x''+(\omega^2 \sin(kx)=0)$, then system's oscillation spectrum excited by a signal containing a set of sinusoidal oscillations will be represented by a set of bell-shaped frequency functions. If at least two such "bells" overlap, there occurs a stochastization of system movement, i.e. system movement gets random nature with a certain probability density of being in one state or another.

The relationship (1) has been obtained from analyzing the condition of "bell" overlapping (that is, resonance overlapping) for a case of flow in a porous medium.

Preferably, the upper boundary of a frequency band in case of acoustic impact on a formation by a multiple frequency wide-band signal with a continuous spectrum should not exceed $10^5$ Hz. If this boundary value exceeded, weak shock waves may appear in oil-saturated formation and this may result in unaccounted effects. Furthermore, such disturbances quickly die out and may not propagate from the source to the porous medium.

The suggested oil recovery enhancement method can be implemented as follows:

FIG. 1 is a schematic view of a well 1 penetrating a formation. Two generators of simple harmonic signals connected in parallel with their amplitude and frequency settings meeting the conditions of formula (1) or a wide-band signal source, for example, a signal generator 5 of wide-band (100 Hz-200 MHz) noise signals are connected through an amplifier 4 to a vibroacoustic emitter 3 which is able to operate under downhole conditions. The emitter is placed in the well 1 at the production layer 2 level which is determined based on a preliminary geophysical survey of the well.

A relative increase in the well yield can be appraised using the formula:

$$\text{yield_increase}(\%) = 10^5 \frac{\alpha W}{\eta \Delta\omega \mathrm{mL}} \cdot 100\%$$

α—compressibility [1/Pa], W—source power [W], η—viscosity [Pa·s], —frequency range [Hz], m—porosity, L—formation thickness [m].

So, for a 1 m-thick formation, with a compressibility of $10^{-10}$-$10^{-8}$ 1/Pa, viscosity of $10^{-3}$-$10^{-2}$ Pa·s, porosity of $10^{-3}$-$10^{-1}$ and with the source power of 1 kW when the formation is subjected to the impact with a frequency range of $10^3$-$10^4$ Hz the yield increase could reach 1 to 20%.

What is claimed is:

1. A method for oil recovery enhancement comprising the steps of:

lowering a vibroacoustic downhole emitter into a well down to a production layer depth and performing acoustic impact on the formation by a multiple-frequency signal containing at least two simple harmonic components whose frequencies and amplitudes meet the resonance overlapping condition $$\left| \frac{1}{2c\sqrt{\rho}} \frac{\omega_1 \sqrt{P_1} + \omega_2 \sqrt{P_2}}{\omega_1 - \omega_2} \right| > 1,$$

where $P_1$ and $P_2$—signal amplitudes [Pa], $\omega_1$ and $\omega_2$—their frequencies [Hz], c—acoustic sound velocity in the formation fluid [m/s], ρ—formation fluid density [g/cm$^3$].

2. The method of claim 1 wherein the impact is performed during at least one of the following: before starting oil production, during oil production, while shutting the well.

3. The method of claim 1 where in the steps of:

lowering a vibroacoustic downhole emitter into a well down to a production layer depth and performing acoustic impact on the formation by a multiple-frequency wide-band signal with a continuous frequency spectrum.

4. The method of claim 3 wherein the upper frequency band limit of the multiple-frequency wide-band signal with a continuous frequency spectrum does not exceed $10^5$ Hz.

5. The method of claim 4 wherein the frequencies band of the multiple-frequency wide-band signal with a continuous frequency spectrum ranges between 100-200 MHz.

* * * * *